US009527092B2

(12) United States Patent
Miyamoto et al.

(10) Patent No.: US 9,527,092 B2
(45) Date of Patent: Dec. 27, 2016

(54) NOZZLE HOLE MECHANISM

(75) Inventors: Hidetoshi Miyamoto, Kyoto (JP); Satoshi Mekata, Osaka (JP)

(73) Assignee: DAIZO CORPORATION, Osaka (JP)

( * ) Notice: Subject to any disclaimer, the term of this patent is extended or adjusted under 35 U.S.C. 154(b) by 614 days.

(21) Appl. No.: 13/704,602

(22) PCT Filed: Jun. 15, 2011

(86) PCT No.: PCT/JP2011/063740

§ 371 (c)(1),
(2), (4) Date: Dec. 14, 2012

(87) PCT Pub. No.: WO2011/158881

PCT Pub. Date: Dec. 22, 2011

(65) Prior Publication Data

US 2013/0087638 A1 Apr. 11, 2013

(30) Foreign Application Priority Data

Jun. 15, 2010 (JP) ..... 2010-136672

(51) Int. Cl.

*B05B 1/00* (2006.01)
*B05B 1/34* (2006.01)
*B65D 83/14* (2006.01)

(52) U.S. Cl.

CPC ..... *B05B 1/341* (2013.01); *B05B 1/3426* (2013.01); *B05B 1/3436* (2013.01); *B65D 83/753* (2013.01)

(58) Field of Classification Search

CPC ..... B05B 1/341; B05B 1/3426; B05B 1/3431; B05B 1/3436; B05B 1/3442; B05B 1/3447

(Continued)

(56) References Cited

U.S. PATENT DOCUMENTS 3,129,893 A * 4/1964 Green ..... B05B 1/3436 222/402.24
3,545,682 A * 12/1970 Beard ..... B05B 1/323 222/151

(Continued)

FOREIGN PATENT DOCUMENTS

EP 0 000 688 A2 2/1979
JP 54-52315 A 4/1979

(Continued)

OTHER PUBLICATIONS

Supplementary European Search Report for the Application No. EP 11 79 5785 dated Oct. 22, 2013.

(Continued)

*Primary Examiner* — Arthur O Hall
*Assistant Examiner* — Viet Le
(74) *Attorney, Agent, or Firm* — Cheng Law Group, PLLC

(57) ABSTRACT

A nozzle hole mechanism (10) is provided with a nozzle hole (28) which ejects a concentrate into the atmosphere, a swirl chamber (30) which supplies the concentrate to the nozzle hole (28), and a path (27) which supplies the concentrate to the swirl chamber (30). The diameter of the nozzle hole (28) is 0.2 mm or less, the length of the nozzle hole (28) is in the range of 0.05-0.3 mm, and the swirl chamber (30) and the nozzle hole (28) are located on the same axis. The swirl chamber (3) is equipped with a front section having a solid cylindrical shape, which communicates with the nozzle hole, and a rear section having an ring shape. The nozzle hole mechanism is configured in such a manner that the concentrate is supplied to the rear section (30*a*) and discharged from the nozzle hole (28) via the front section (30*b*). The configuration enables the nozzle mechanism to spray fine particles over a wide area using small spray amount.

7 Claims, 8 Drawing Sheets

(58) Field of Classification Search
USPC ..... 239/463, 469, 490
See application file for complete search history.

(56) References Cited

U.S. PATENT DOCUMENTS

| | | | | |
|---|---|---|---|---|
| 3,711,031 | A | 1/1973 | Ewald | |
| 3,881,658 | A * | 5/1975 | Greenebaum, II ..... | B65D 83/20 239/492 |
| 5,769,325 | A | 6/1998 | Jouillat et al. | |
| 6,722,585 | B1 * | 4/2004 | Stradella ..... | 239/533.13 |
| 2008/0121738 | A1 * | 5/2008 | Togashi ..... | B05B 1/341 239/406 |
| 2009/0057447 | A1 * | 3/2009 | Lowry et al. ..... | 239/601 |

FOREIGN PATENT DOCUMENTS

| | | | |
|---|---|---|---|
| JP | 2-48158 | U | 4/1990 |
| JP | 3-114248 | U | 11/1991 |
| JP | 2000-153188 | A | 6/2000 |
| JP | 2000-238868 | A | 9/2000 |
| JP | 2001-180770 | A | 7/2001 |
| WO | WO-97/13584 | A1 | 4/1997 |
| WO | WO-2007/004314 | A1 | 1/2007 |

OTHER PUBLICATIONS

International Search Report for the Application No. PCT/JP2011/063740 mailed Sep. 20, 2011.

* cited by examiner (a)

(b)

NOZZLE HOLE MECHANISM

FIELD OF THE INVENTION

The present invention relates to a nozzle hole mechanism. For further details, it relates to a nozzle hole mechanism of a spray member attached to spray products such as aerosol products, pump products.

DESCRIPTION OF BACKGROUND ART

In a product which pressurizes and discharges a content (concentrate) in a container such as aerosol products and pump products, a nozzle hole mechanism which discharges (sprays) the, content as a fine mist is known.

In Patent Document 1, a nozzle hole mechanism for an aerosol product is disclosed. This nozzle hole mechanism is equipped with a mechanical break up mechanism provided with a conically shaped swirl chamber inside of the nozzle hole. This mechanical break up mechanism is equipped with a spray groove, formed so as to contact an outer peripheral edge of the swirl chamber, and the content is led into interior of the swirl chamber through this spray groove. Hence, the content is sprayed from the nozzle hole while swirling in the swirl chamber. Thereby, the spray particles of the content are micronized and discharged, making it possible to spray widely.

In Patent Document 2, a nozzle hole mechanism for a hand pump is disclosed. This nozzle hole mechanism is equipped with a plurality of vanes (paths), a swirl chamber, and a mechanical break up mechanism of which the nozzle orifice (nozzle hole) is made to be a specific size.

In Patent Document 3, a nozzle hole mechanism for an aerosol product is disclosed, in which a swirling force is given two times. Stated differently, a column like core is inserted into the nozzle hole of a button body, and a discharge hole is formed in the surface thereof. In the rear face of the core, an upper stream side recessed path which leads the content supplied to the rear surface of the core so as to rotate around the core is formed. In the front surface of the core, a downstream side recessed path which leads the content, which is led while being rotated, to a circular recessed portion (swirl chamber) so as to further enhance the rotation is formed.

PRIOR ART DOCUMENTS

Patent Documents

Patent Document 1: Japanese published Patent Application 2000-153188

Patent Document 2: Japanese published Patent Application H11-513608

Patent Document 3: International Publication Number WO2007/004314

DESCRIPTION OF THE INVENTION

Problems to be Solved

However, while, a new product or a commodity is developed, a new product which provides a different spray condition from the conventional one is demanded. To be more precise, the product which sprays widely in soft spray condition with a small amount is demanded. Particularly, a nozzle hole mechanism equipped with a nozzle hole whose diameter is made to be 0.2 mm or less is expected to make spray particles small and to spray with a wide angle. However, since the nozzle hole is small, resistance applied to a content right before the nozzle hole is large, the flow speed near the nozzle hole lowers, and the content becomes heavy flow turbulence, causing the content to be discharged in the shape of rod as it is.

The present invention is directed to respond to such a demand, and to provide a nozzle hole which sprays widely with a smaller amount of spray serving for a soft spray condition.

Problems to be Resolved by the Invention

The nozzle hole mechanism of the present invention is the nozzle hole mechanism used in a spray product which sprays a concentrate by pressurizing and comprises a nozzle hole which discharges the concentrate into the atmosphere, a swirl chamber having a cylindrical column shape which supplies the concentrate to the nozzle hole, of which the diameter is larger than the nozzle hole, and a path which supplies the concentrate to the swirl chamber. The swirl chamber and the spray nozzle are located on the same axis. The swirl chamber is equipped with a front portion having a cylindrical column shape which communicates with the nozzle hole and an back portion having a ring shape, and the front portion and the back portion are lined up coaxially. The path communicates with the swirl chamber so that the concentrate supplied to the swirl chamber swirls in one direction in the back portion of the swirl chamber.

In such nozzle hole mechanism, it is preferable that a plurality of the paths is formed to be rotation symmetry around the center axis of the swirl chamber.

In such nozzle hole mechanism, it is preferable that the diameter of the nozzle hole is 0.2 mm or less. In this case, it is preferable, that the area of the path is three to ten times of the area of the nozzle hole.

The second aspect of the present invention is the nozzle hole mechanism used in a spray product which sprays a concentrate by pressurizing, and comprises a nozzle hole which discharges the concentrate into the atmosphere, a swirl chamber which supplies the concentrate to the nozzle hole, and a path which supplies the concentrate to the swirl chamber. The diameter of the nozzle hole is 0.2 mm or less, and the length of the nozzle hole is 0.05-0.3 mm. The swirl chamber and the nozzle hole are located on the same axis. The concentrate is sprayed at an angle, of 30-120 degrees.

In such nozzle hole mechanism, it is preferable that the swirl chamber is equipped with a front portion which communicates with the nozzle hole and a back portion having a ring shape. The concentrate is being supplied to the back portion, and being discharged from the nozzle hole through the front portion.

Moreover, in such nozzle hole mechanism, it is preferable that the shape of the space of the back portion is cylindrical, or, it is preferable that the inner diameter of the shape of the space of the back portion is diameter-reduced toward the nozzle hole.

Effect of the Invention

The nozzle hole mechanism of the present invention is the nozzle hole mechanism used in a product which sprays a concentrate by pressurizing; and comprises a nozzle hole which discharges the concentrate into the atmosphere, a cylindrical column like swirl chamber which supplies the concentrate to a nozzle hole, of which the diameter is larger than the nozzle hole, and a path which supplies the concentrate to the swirl chamber; in which the swirl chamber and the spray nozzle are located on the same axis, in which the swirl chamber is equipped with a front portion having a cylindrical column shape which communicates with the nozzle hole and a back portion having a ring shape and the front portion and the back portion are lined up coaxially, and in which the path communicates with the swirl chamber so that the concentrate supplied to the swirl chamber swirls in one direction in the back portion of the swirl chamber. Thereby, it is possible to spray the concentrate widely. Stated differently, the concentrate is led from the path into the swirl chamber so as to swirl in the back portion of the swirl chamber, and rotates in the back portion with the impetus of the flow being as it is. Then, the concentrate is sent to the front portion of the swirl chamber, while maintaining the swirl radius and the high rotation speed in the back portion of the swirl chamber. Further, the concentrate flows toward the nozzle hole which is the center in the front portion having a circular column like space, while maintaining the rotation speed. Here, the swirl radius of the concentrate becomes small down to the nozzle hole diameter from the diameter of the front portion, accompanying the increase of the rotation speed. And, since the stock concentrate dashes out from the nozzle hole at the rotation speed in the nozzle hole, it expands widely. Thus, since it is possible to enhance the rotation speed of the concentrate, particularly, even the nozzle diameter is small and the spray amount per unit of time is small, the concentrate can be sprayed widely.

In such nozzle hole mechanism, in the ease that a plurality of the paths is formed to be rotation symmetry around the center axis of the swirl chamber, the concentrate can be rotated more efficiently in the swirl chamber.

In such nozzle hole mechanism, in the case that the diameter of the nozzle hole is 0.2 mm or less, the spray amount per unit of time becomes small, making very soft spray possible.

In such nozzle hole mechanism, the area of the path is three to ten times of the area of the nozzle hole, the concentrate led into the swirl chamber receives less resistance, making it possible to spray widely in a stable state.

In the nozzle hole mechanism of the present invention, since the diameter of the nozzle hole is 0.2 mm or less, and the length of the nozzle hole is 0.05-0.3 mm, and the concentrate is sprayed at an angle of 30-120 degrees, regardless of the small amount of spray, the concentrate expand easily and, sprayed in a very soft sprayed condition.

In such nozzle hole mechanism, in the case that the swirl chamber is equipped with a front portion communicating with the nozzle hole and a back portion having ring shaped, where the concentrate is supplied to the back portion, and discharged from the nozzle hole through the front portion, the concentrates sent to the back portion of the swirl chamber do not collide each other, and rotates in the back portion without losing the impetus of the flow. And, since it is possible to send the concentrate to the front portion of the swirl chamber, while maintaining the swirl radius in the back portion of the swirl chamber and high rotation speed, and to discharge from the nozzle hole, it is possible to spray the concentrate widely even the nozzle hole radius is small and the amount of spray is small.

In the case that the shape of the space of the back portion is cylindrical, the swirl radius is easy to be maintained in the back portion, therefore the concentrate is sent to the outer periphery of the front portion of the swirl chamber in large swirls (large diameter), and moves at a high speed toward the central nozzle hole. Moreover, because the swirl chamber forms a recessed space (cross section being approximately C character shape) making the nozzle hole to be the bottom center, the volume thereof becomes small. Hence, the concentrate led into the swirl chamber does not accumulate in the swirl chamber and flows smoothly, and can be sprayed from the nozzle hole while maintaining the rotation speed. Thereby, the concentrate is dispersed widely.

In the case that the inner diameter of the back portion is diameter-reduced toward the nozzle hole, the rotation radius of the concentrate can be made small toward the front portion of the swirl chamber. In other words, the rotation speed can be raised toward the nozzle hole.

BEST MODE FOR CARRYING OUT THE INVENTION

Figure 1:
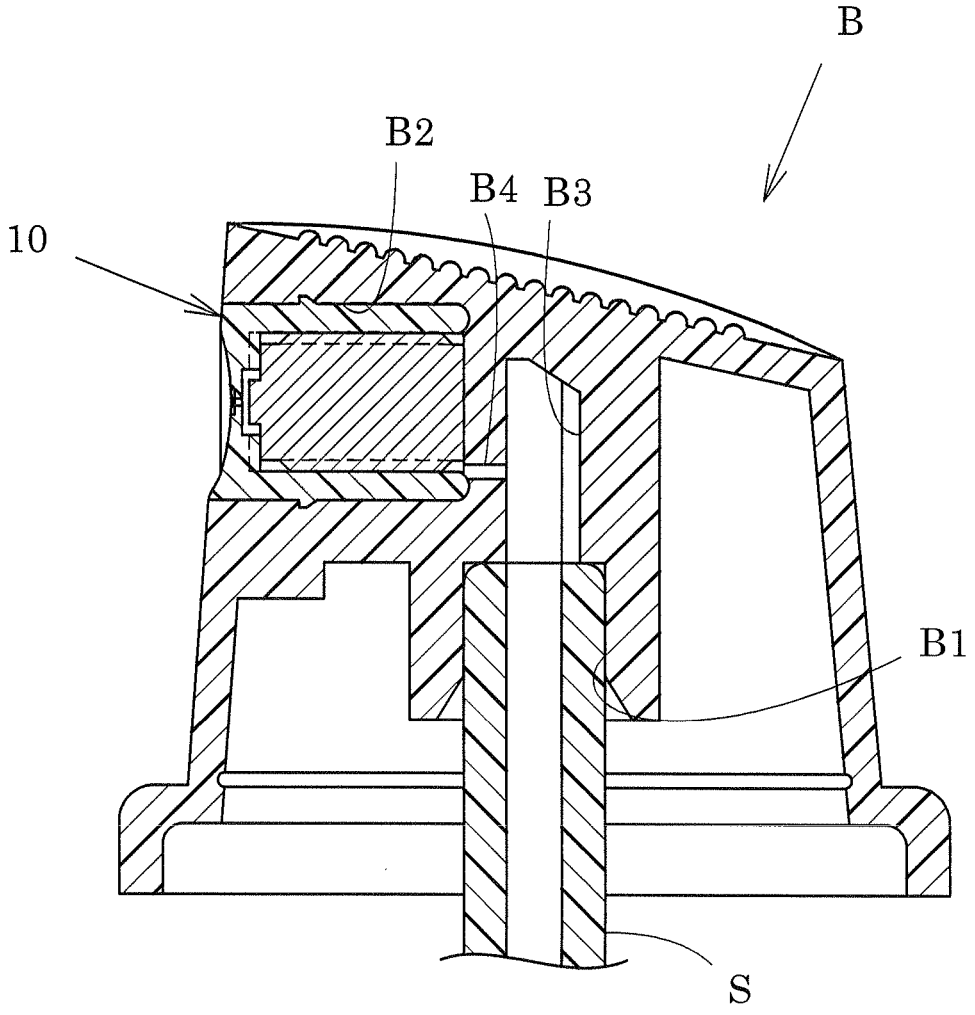
FIG. 1 is a side cross sectional view showing the spray member equipped with the nozzle hole mechanism of the present invention.

A spray button B of FIG. 1 is that which is attached to a stem S of a spray product such as aerosol products and pump products; and is equipped with a nozzle hole mechanism 10 of the present invention.

The spray button B has a column like shape, and has a stem engaging portion B1 engaging with the stem S formed in the lower end thereof, a nozzle engaging portion B2 engaging with the nozzle hole 10 formed in the side face thereof, and a path B3 within the button connecting those. Particularly, the path B3 within the button is equipped with a communicating hole B4 which directly communicates with the nozzle engaging portion B2. Since being configured as described above, a concentrate supplied from the stem S is led into the nozzle hole mechanism 10 through the path B3 within the button, the communicating hole B4, like shown in FIG. 1.

Figure 2:
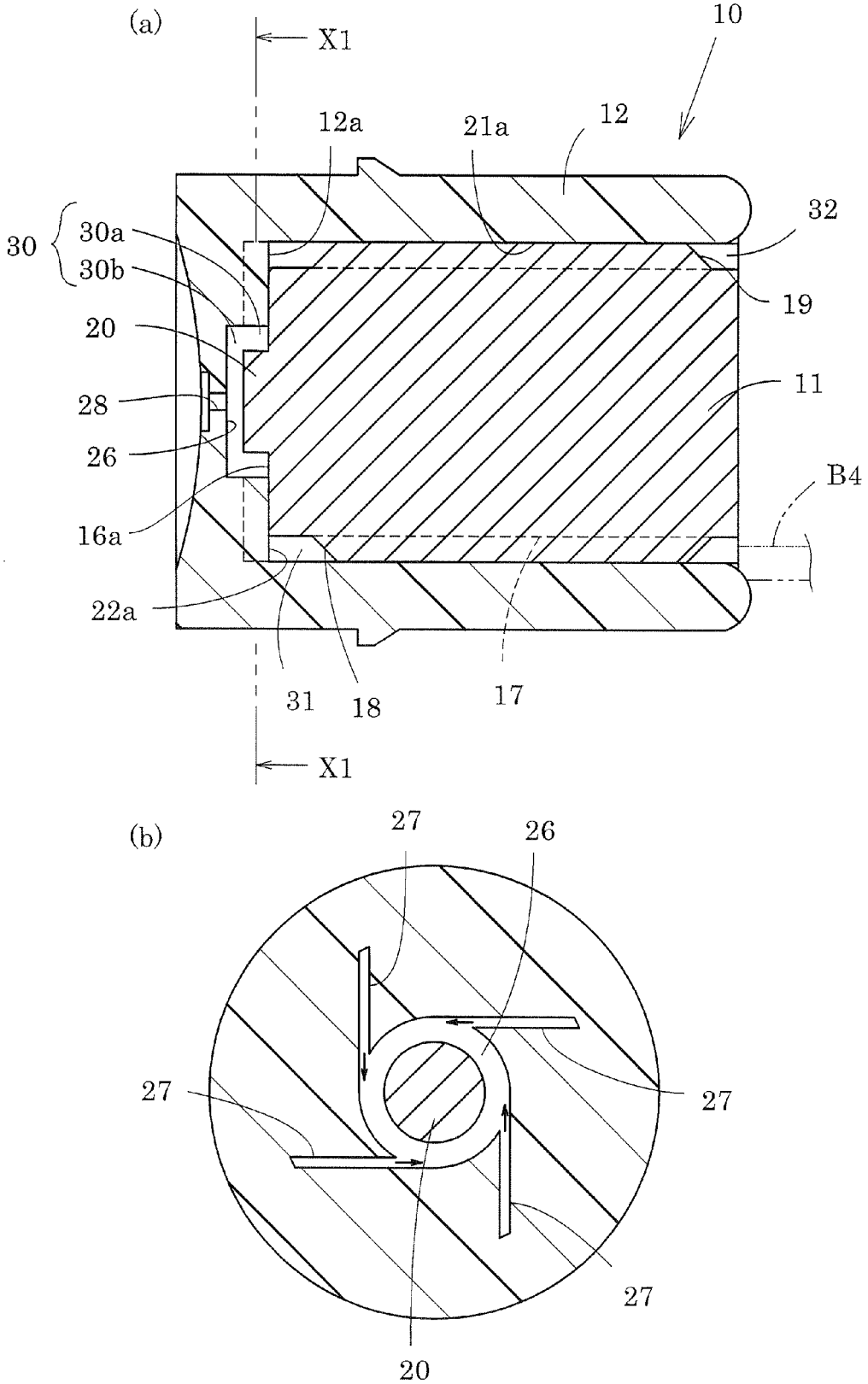
FIG. 2*a* is a side cross-sectional side view showing an embodiment of the nozzle hole mechanism of the present invention.
FIG. 2*b* is an X1-X1 line cross-sectional view thereof.

The nozzle hole mechanism 10 is equipped with, a core 11 having a cylindrical column shape, inserted into the nozzle, engaging portion B2, and a nozzle piece 12 having a cylindrical shape, which closes the nozzle engaging portion B2, which is being inserted into the nozzle engaging portion B2 while covering whole of the core 11, like shown in FIG. 2. Moreover, the center axis of the core 11 and the nozzle piece 12 are on the same axis. A space formed between the core 11 and the nozzle piece 12 serves as a swirl chamber (space) 30. Moreover, this swirl chamber 30 has a back portion 30*a* of which the shape of the space is cylindrical, and a front portion 30*b* of which the shape of the space is cylindrical column like. The nozzle hole mechanism 10 is that which swirls the concentrate into this swirl chamber, and sprays the concentrate from the nozzle hole while swirling it. Thereby, it is a mechanism that can spray the concentrate widely.

Figure 3:
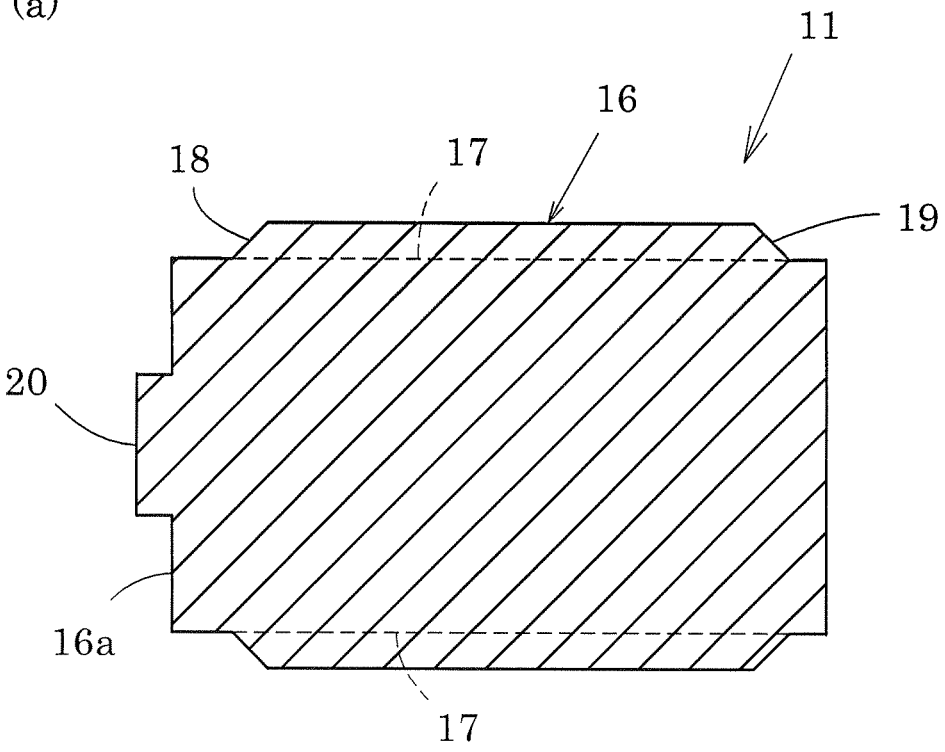
FIG. 3*a, b* are respectively a side view, it front view showing the core of the nozzle hole mechanism of FIG. 2.
Figure 3:
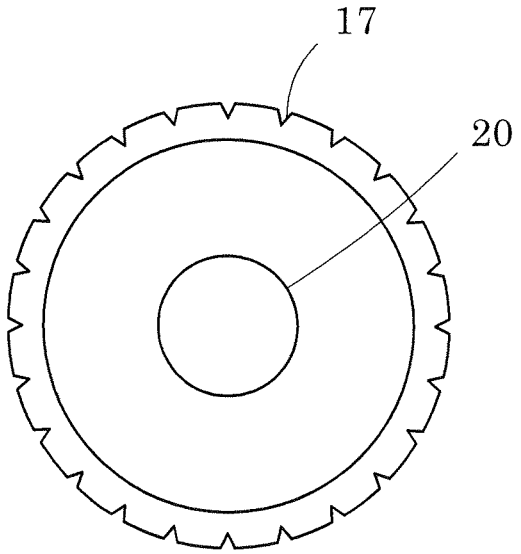

The core 11 is equipped with a cylindrical column like body 16, and has to plurality of grooves 17 formed on the side face thereof in parallel to the axis of the body, a front taper portion 18 which is diameter-reduced facing toward front in the front end portion of the body side face, and a back taper portion 19 which is diameter-reduced facing toward back in the back end potion of the body side face, and a protruding portion 20 having a cylindrical column shape protruding from a front face 16*a*, like shown in FIG. 3*a, b*.

A plurality of the grooves 17 is provided in the cylindrical side face of the core in the axis direction at a uniform interval. The provision of the plurality of grooves makes the groove serve as a filter, making it possible to prevent choking, even when as very small nozzle hole of the diameter as small as 0.2 mm or less is used, and even if foreign matters such as dust and dirt are mixed in the content. For example, the cross sectional area of the groove 17 is preferable to be smaller than the area of the nozzle hole. More specifically, it is preferable to be 1/10-1/2, particularly to be 1/5-1/3 of the area of the nozzle hole. However, the total area of the groove is configured so as to be more than the area of the nozzle hole. Further, the groove may be provided spirally. In this case, the distance in which the concentrate passes becomes long, making it possible to suppress a spray amount.

The protruding portion 20 is a cylindrical column like portion protruding from the center of the front face 16*a* of the body. The protruding portion 20 has an action to adjust the volume of the swirl chamber 30 according to the size of the nozzle hole to maintain the rotation speed of the concentrate in the swirl chamber 30, or to make the rotation of the concentrate faster, and to send the concentrate to the nozzle hole while swirling the concentrate.

The outer diameter of the protruding portion 20 is preferable to be 0.5-5 mm, particularly to be 0.7-3 mm. And, it is preferable to be 30-90% of the inner diameter of a later described recessed portion 26 of the nozzle piece 12, particularly to be 35-85%. When the outer diameter of the protruding portion 20 is smaller than 30% of the inner diameter of the recessed portion 26, the swirling radius in the front portion 30*b* becomes small making the swirling radius in the front portion 30*b* small, the rotation speed becomes low, and it becomes not possible to spray widely. Moreover, the swirling of the concentrate is easy to become turbulent, making it not possible to spray stably. When it is larger than 90%, the concentrate receives a path resistance, the rotation speed is easy to be lowered, making it not possible to spray widely. Moreover, the height thereof is preferable to be 0.03-0.5 mm, particularly to be 0.05-0.3 mm. And, it is preferable to be 10-80% of the height of the recessed portion 26 of the nozzle piece 12, particularly to be 12-70%. When the height of the protruding portion 20 is smaller than 10% of the height of the recessed portion 26, the space between the front end face of the protruding portion and the bottom portion of the recessed portion becomes large, the rotation speed of the concentrate is lowered, making it not possible to spray widely. When it is larger than 80%, the concentrate receives the path resistance, and the rotation speed is easy to be lowered, making it not possible to spray widely.

Moreover, the volume of the protruding portion 20 is preferable to be 5-60% of the recessed portion 26, particularly to be 7-50%. When the volume of the protruding portion 20 is smaller than 5% of the volume of the recessed portion, the volume of the swirling chamber 30 becomes large. Particularly, when the nozzle hole diameter is as small as 0.2 mm or less, the staying time of the concentrate in the swirling chamber 30 becomes long and the rotation speed is lowered in a large way, making it not possible to spray widely, even the concentrate is led into the swirling chamber at high speed. Moreover, after a spray operation is stopped, the concentrate sprayed from the nozzle hole, or dripping off from the nozzle hole tends to increase. When the volume of the protruding portion 20 is larger than 60% of the recessed portion 26, the concentrate receives the path resistance, the rotation speed is easy to be lowered, making it not possible to spray widely.

Figure 4:
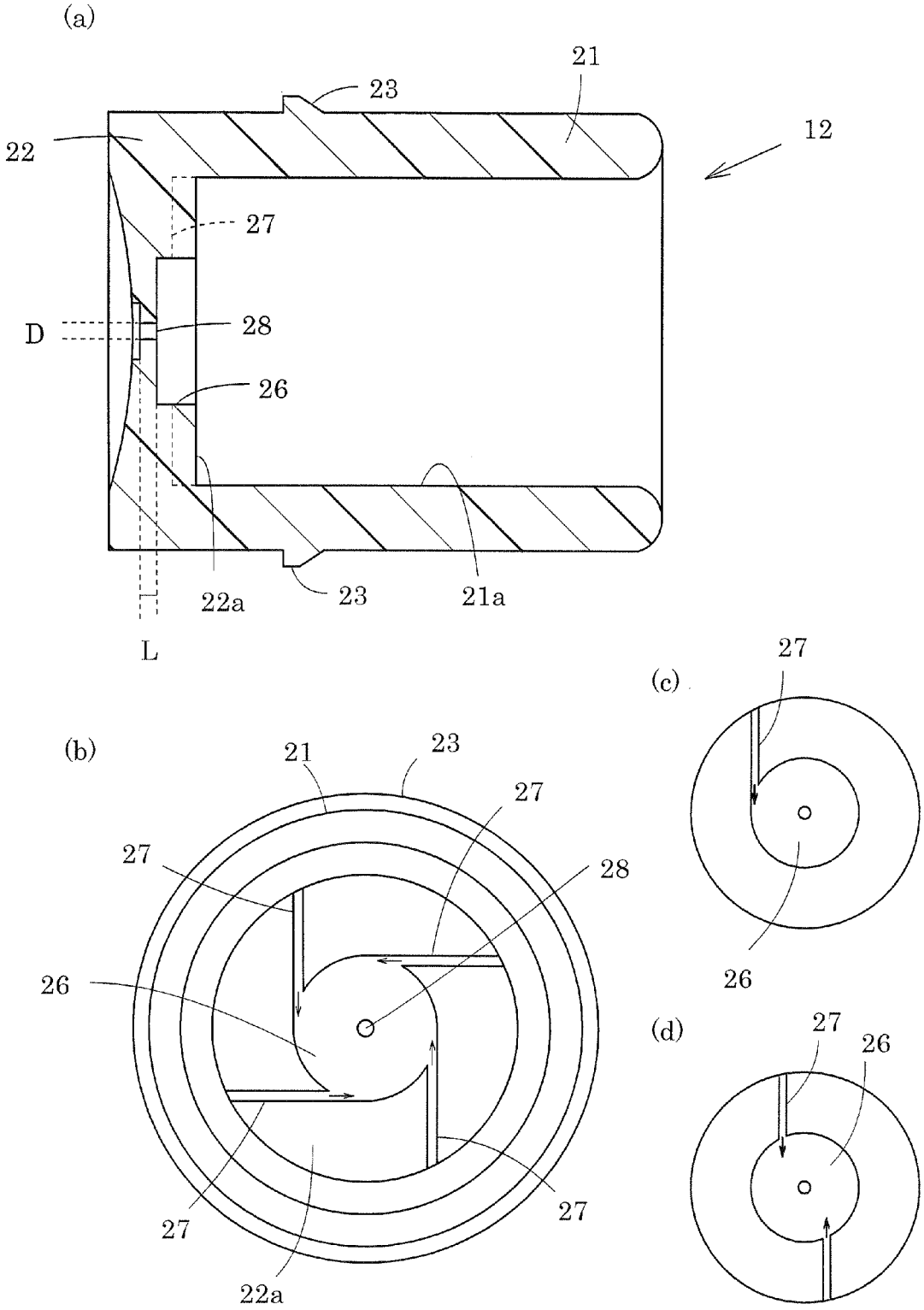
FIG. 4*a, b* are respectively a side view, and a back view showing the nozzle piece of the nozzle hole mechanism of FIG. 2.
FIG. 4*c, d* are respectively a back view showing the other embodiment of the nozzle piece which can be used in the nozzle hole mechanism of FIG. 2.

The nozzle piece 12 is equipped with a cylindrical barrel portion 21 and a front wall portion 22 closing the front end thereof, like shown in FIGS. 4*a*, 4*b*.

The barrel portion 21 has an annular engaging portion 23 protruding from the side face thereof. However, a plurality of the engaging portions 23 may be formed annularly at an equal interval. The engaging portion 23 engages with the nozzle engaging portion B2 of the button, and serves as a portion to fix the nozzle piece 12.

The front wall portion 22 has the circular recessed portion 26 formed in the central inside face thereof, a plurality of groove paths 27 formed toward the side edge from the recessed portion 26 of the central inside face, and a nozzle hole 28 formed in the center of the recessed portion 26.

The diameter of the recessed portion 26 is preferable to be 0.7-7 mm, particularly to be 1-5 mm. However, it may be good if it is larger than the diameter of a later described nozzle hole 28. Moreover, the height of the recessed portion 26 is preferable to be 0.1-1 mm, particularly to be 0.2-0.6 mm.

The groove path 27 is a path to supply the concentrate to the recessed portion 26 constituting the swirl chamber 30. A plurality (in the present embodiment, four) of groove path 2 is formed so as to contact the outer circumference of the recessed portion 26, and is formed so as to be rotation symmetry making the center of the recessed portion 26 as an axis. Thereby, the concentrate flowing through the groove path 27 is supplied from the outer circumference to interior of the recessed portion 26, and swirls (arrow head of FIG. 4*b*). Moreover, the groove path 27 is provided annularly at an equal interval. Further, the depth of the groove path 27 is configured to be the same height as the protruding portion 20, or to be smaller than it. However, the number of the groove path 27 may be one, if it is configured so that the concentrate supplied to the recessed portion 26 swirls in one direction (refer to FIG. 4*c*). Moreover, the route thereof may be that faces toward interior of the recessed portion 26, not contacting the outer circumference of the recessed portion 26 (refer to FIG. 4*d*).

It is preferable that the diameter D of the nozzle hole 28 is formed to be 0.2 mm or less, particularly to be 0.05-0.18 mm. By forming it so as to be 0.2 mm or less, the spray amount per unit time can he made small, and the spray particle can be made further fine. The length L of the nozzle hole 28 is made to be 0.05-0.3 mm. When the length L of the nozzle hole 28 is smaller than 0.05 mm or less, the spray strength will be weak, and it will deform by the impetus of spray, or, there is a risk to be broken. When it is larger than 0.3 mm, the expansion of the spray will be suppressed by the nozzle hole, and the impetus of the spray tends to become strong.

Particularly, when the diameter of the nozzle hole is 0.2 mm or less, the area of the path (groove path 27) is preferable to be 3-10 times of the area of the nozzle hole. When the area ratio is smaller than three times, the amount of supply of the concentrate supplied to the swirl chamber will not be sufficient, and the concentrate may be sent to the nozzle hole without giving a sufficient swirling force, causing the wide spray being disturbed. When the area ratio is larger than ten times, the amount of the concentrate led into the swirl chamber will be limited, and the rotation speed is lowered in a large way, making it not possible to spray widely. In addition, when the path is plural, it is the total area.

Returning to FIG. 2, the state in which the core 11 and the nozzle piece 12 is connected is described. The core 11 and the nozzle piece 12 are connected so that the front face 16*a* of the core 11 and the inner face 22*a* of the front wall portion of the nozzle piece 12 contact. Thereby, an approximately C character like space 30 is formed by the recessed portion 26 of the nozzle piece, the front face 16*a* of the core, and the protruding portion 20 of the core. This space is shaped so that the back portion is subsided, and serves as the swirl chamber of the present invention. This space (swirl chamber) 30 formed of the back portion 30*a* where the shape of space is cylindrical, and the front portion 30*b* where the shape of space is cylindrical column. The front portion 30*b* and the back portion 30*a* are aligned on the same axis.

Moreover, a circular ring-like space 31 is also formed between an inner face 22*a* of the front wall portion of the nozzle piece and a front taper portion 18 of the core. Further, a circular ring-like space 32 is also formed between an inner face 21*a* of the barrel portion of the nozzle piece and the back taper portion 19 of the core.

Since it is configured as described above, the concentrate is led into the space 32 from the communicating hole B4. In this space 32, the concentrate is delivered to whole circumference of the core 11, and is sent to the space 31 passing through the groove 17. Then, the concentrate is delivered to four groove paths 27 from the space 31, and is sent to the back portion 30*a* of the space 30 (swirl chamber). In other words, the concentrate is sent from the outer circumference so as to rotate in the back portion 30*a* of the space (swirl chamber) 30. At this time, the protruding portion 20 of the core 11 serves as the center axis of the concentrate, preventing mutual colliding of the concentrates. Further, since it determines the swirl radius of the concentrate, and makes the volume in the swirl chamber small, the rotation speed of the concentrate is maintained or raised, in the back portion 30*a* of the swirl chamber 30. And, the concentrate is sent to the front portion 30*b* of the swirl chamber under the high rotation speed. In the front portion 30*b*, the concentrate flows between the bottom face of the recessed portion 26 and the front end face of the protruding portion facing the central nozzle hole while swirling. In the nozzle, hole 28, the swirl radius of the concentrate is reduced, and the concentrate passes through it accompanying the increase of the rotation speed. Thus, the concentrate is sprayed from the nozzle hole 28 while the rotation speed thereof is raised. As described above, since the concentrate is discharged from the nozzle hole 28 with sufficient rotation speed, the concentrate can be sprayed wider than a normal condition. Particularly, since the rotation of the concentrate is maintained even when it passes through the nozzle hole 28 of which has a small diameter, it is sprayed widely by the rotation force, after passing through the nozzle hole 28. The spray angle of the concentrate sprayed from the nozzle hole can be adjusted according to the nozzle hole diameter D, the nozzle hole length L, and the impetus of the concentrate. Particularly, it can be adjusted arbitrarily in the angle of 30-120 degree. Hence the impetus of the concentrate in the axial direction can be weakened so as to be capable of obtaining a soft spray condition.

The nozzle hole mechanism of the present invention can be used for aerosol products in which the concentrate (content) is charged together with a propellant, and for a nozzle button of pump products in which the concentrate is charged in a pump container. As such stock concentrates, for example, a skin lotion, it cooling agent, a sunscreen, a hot flush stopper, a hair spray, a sterilizer, an analgesic, an antipruritic agent, an insect repellant etc. for human body use, for gardening use can be cited. By leading the above described stock concentrate into the nozzle hole of the present invention, with a pressure by a propellant such as nitrogen gas, carbon dioxide gas, compressed air, or with a pressure a pump, it is possible to spray widely and softly, even the nozzle hole is made small, and the spray amount is made small.

Figure 5:
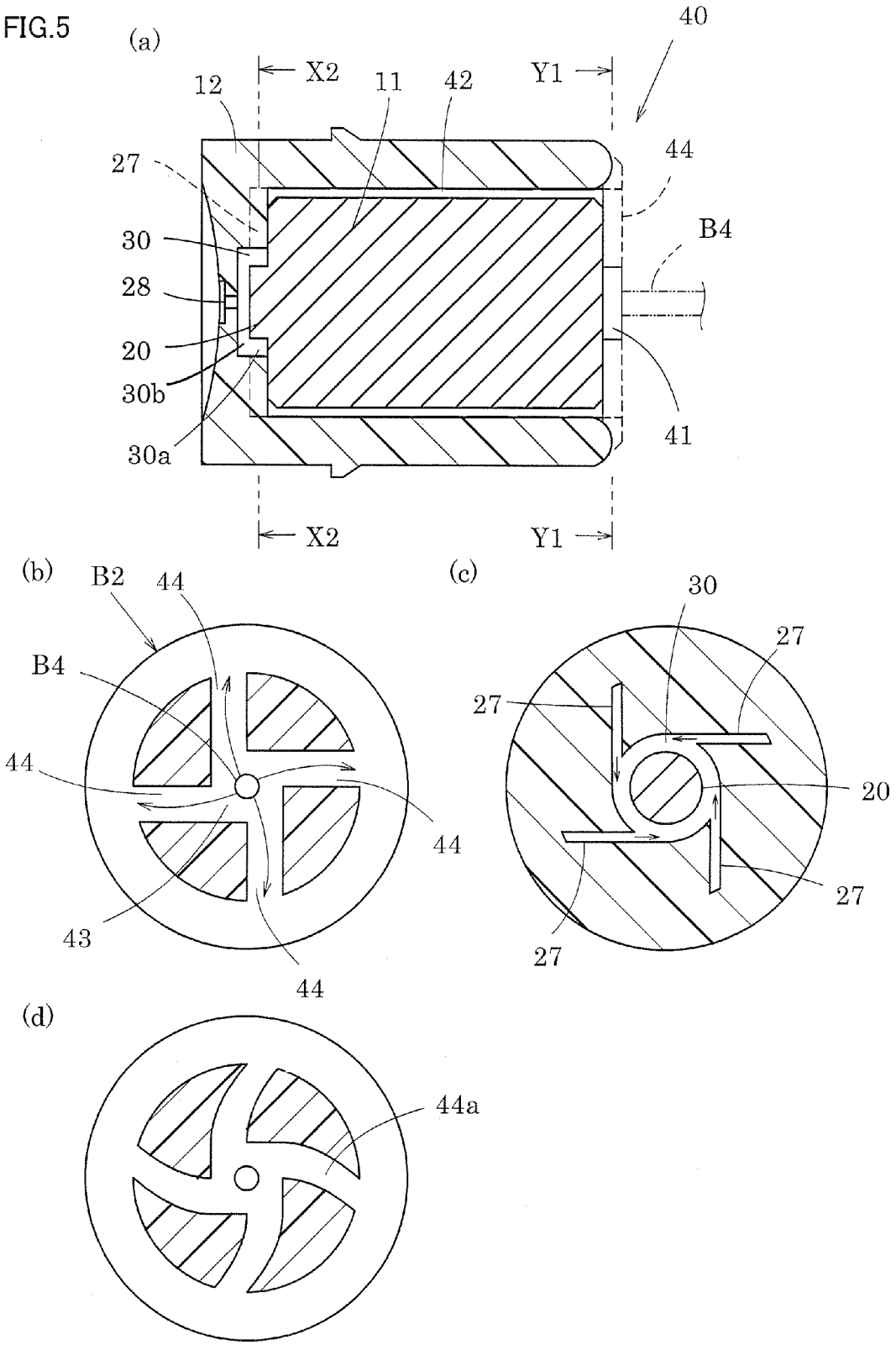
FIG. 5*a* is a side cross sectional view showing the other embodiment of the nozzle hole mechanism of the present invention.
FIG. 5*b, c* are a Y1-Y1 line cross sectional view, and an X2 -X2 line cross sectional view thereof.
FIG. 5*d* is the other embodiment of the Y1-Y1 line cross sectional view.

A nozzle hole 40 of FIG. 5 is that in which a swirl chamber 41 is provided not only in the front of the core but also in the back of the core. In this case, the communicating hole B4 is arranged so as to communicate in the vicinity of the center of the core 11. Moreover, the groove 17 is not provided in the side face of the core 11, instead an annular space 42 is formed between the side face of the core and the inner face of the barrel portion of the nozzle piece 12. Further, the core 11 is fixed by a rib (not shown in the figure) formed annularly or partially in either of the side face of the core or the inner face of the barrel portion of the nozzle piece 12.

Moreover, in the inner face of the nozzle engaging portion B2, a circular second recessed portion 43 (swirl chamber 41) and a plurality (in this embodiment, four) of groove paths 44 extending toward a side edge from this second recessed portion 43 are formed (refer to FIG. 5). The groove path 44 is provided rotation-symmetrically so as to contact the outer circumference of the recessed portion 43. However, it is sufficient that if this groove path 44 is configured so that the concentrate passing through the groove path 44 rotates in the annular space 42. For example, the groove path 44 may be bent somewhat in a direction to rotate the stock concentrate, like shown in FIG. 5.

Since being configured as described above, the concentrate is led into the back swirl chamber 41 from the communicating hole B4. Here, the concentrate collides with the rear surface of the core, and sent to the annular space 42, being guided by the groove path 44. At this time, since the groove path 44 is extended so as to contact the outer circumference of the hack swirl chamber 41, the concentrate sent from the groove path 44 proceeds forward while rotating in the annular space 42 (in FIG. 5, right-handed rotation). Moreover, since a rib (not shown in the figure) is formed annularly and partially, it does not disturb the rotation of the concentrate in the annular space 42. The concentrate sent forward while rotating in the annular space 42 is sent to the interior of the back portion 30*a* of the swirl chamber 30 from the groove path 27 formed along the rotation direction. At this time, the swirl radius of the concentrate becomes small from the diameter of the annular space to the diameter of the back portion of the swirl chamber 30, therefore the rotation speed increases by just that much (refer to FIG. 5*c*). In the back portion 30*a* of the swirl chamber 30, the rotation speed thereof is maintained or raised. Because the protruding portion 20 of the core serves as the center axis of the stock concentrate, and prevents the collision of mutual stock concentrates, further, makes the volume in the swirl chamber small, while maintaining the size of the swirl radius, as described above. And since the concentrate is discharged from the nozzle hole 28 through the front portion 30*b* with this high speed rotation, it is sprayed more widely and more finely.

In FIG. 5*d*, the other shape of the inner face of the nozzle engaging portion B2 is shown. Stated differently, a groove path 44*a* is bent in a direction to rotate the concentrate. Thereby, the rotation speed of the concentrate is raised than that of FIG. 5*b*.

Figure 6:
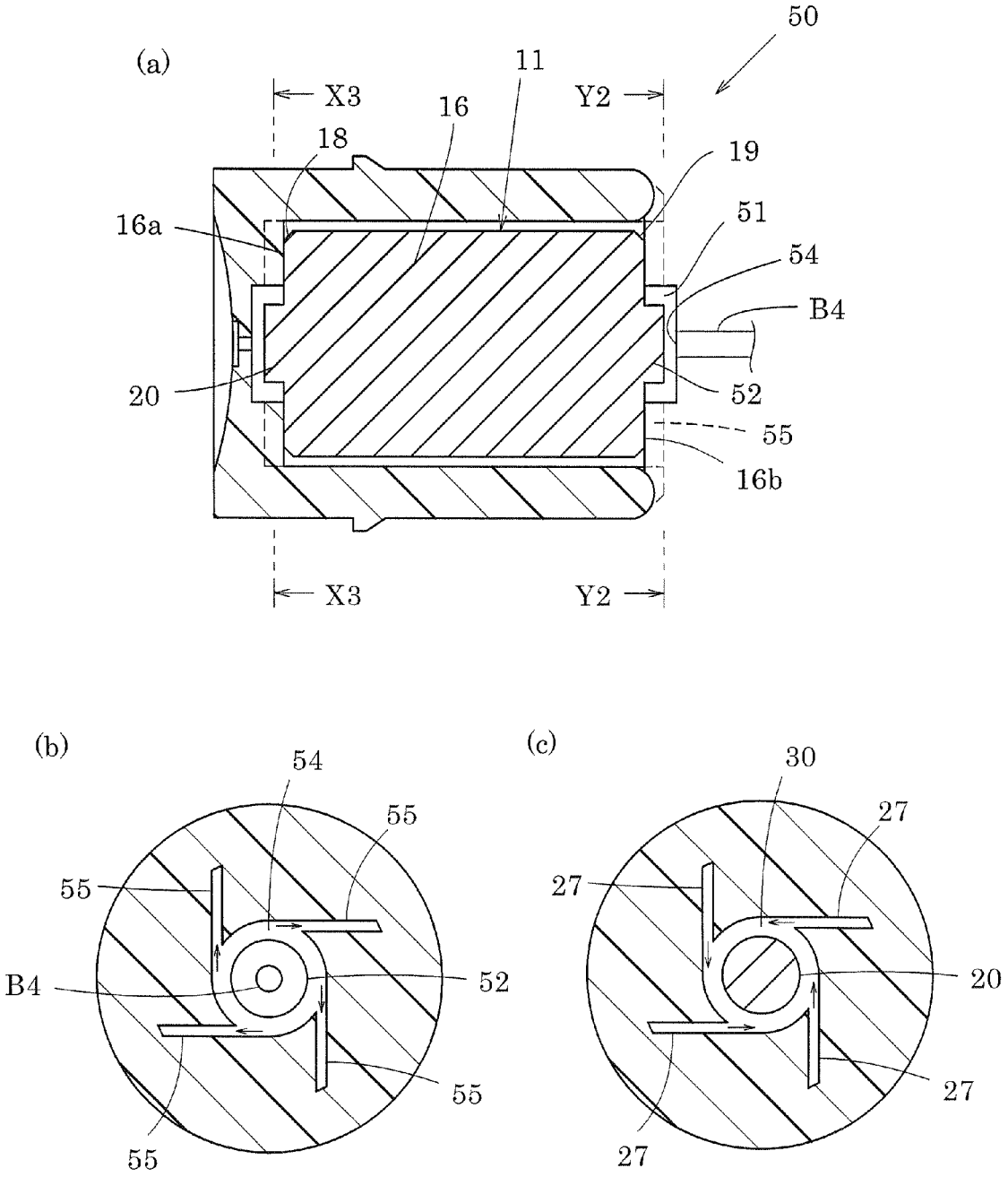
FIG. 6*a* is a side cross sectional showing further the other embodiment of the nozzle hole mechanism of the present invention.
FIG. 6*b, c* are a Y2-Y2 line cross-sectional view, and an X3-X3 line cross sectional view.

A nozzle hole 50 of FIG. 6 is also has a back swirl chamber 51 in the back portion of the core 11, and the space of the swirl chamber is shaped to be recessed same as the front swirl chamber 30.

The core 11 has the front taper portion 18 which is diameter-reduced toward the front end portion of the cylindrical column like body 16 facing forward, the back taper portion 19 which is diameter-reduced toward the back of the back end portion of the body facing backward, and the cylindrical column like protruding portion 20 protruding from the front face 16*a*, and a cylindrical column like protruding portion 52 protruding from the back face 16*b*. Stated differently, the back swirl chamber 51 is shaped to be cylindrical in which the nozzle hole side is opened.

In the inner face of the nozzle engaging portion B2, a circular recessed portion 54 formed in the center thereof, and a plurality of groove paths 55 formed toward the side edge of the central inner face from the recessed portion 54 is formed (refer to FIG. 6*b*).

Being configured as described above, the concentrate led into the back swirl chamber 51 from the communicating hole B4 collides with the protruding portion 52 of the core, and flows toward the groove path 55 from the back swirl chamber 51 while swirling, making the protruding portion 52 as the center axis. Hence, the concentrate is sent to the annular space 42 with faster rotation. The concentrate sent forward while rotating in the annular space 42 is sent to interior of the swirl chamber 30 from the groove path 27 formed along the rotation direction further fast rotation speed (refer to FIG. 6*c*).

Since the protruding portion 20 of the core serves as the center axis of the concentrate as described above, the core suppresses the collision of the mutual concentrates, and, the core makes the volume in the swirl chamber smal while maintaining the swirl radius of the concentrate, the rotation speed of the concentrate is maintained or raised in the back portion 30*a* of the swirl chamber 30. Since the content is discharged from the nozzle hole 28 in this high rotating state, it can be sprayed more widely and more finely.

Figure 7:
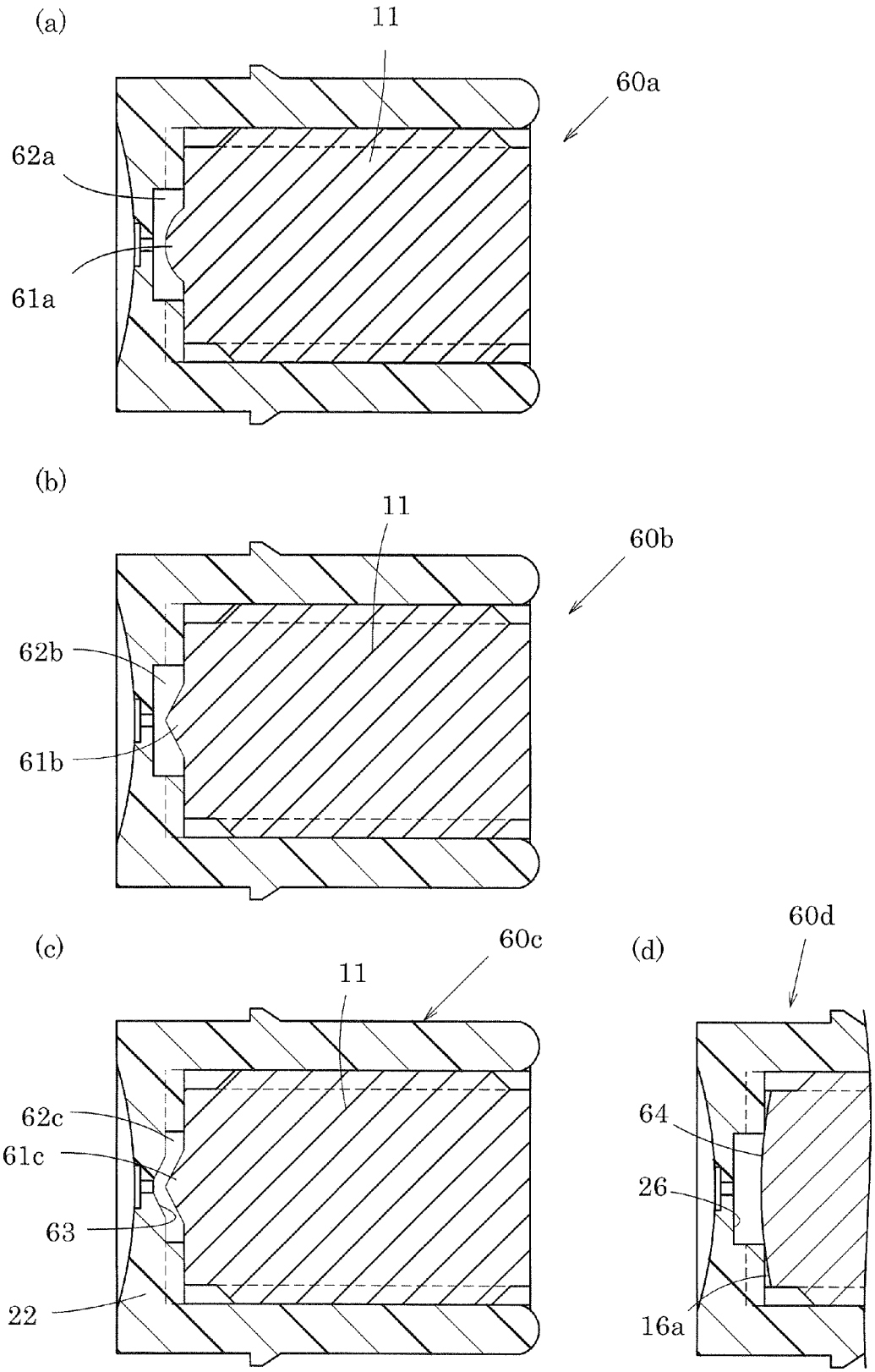
FIG. 7*a, b, c, d* are respectively cross sectional views showing further the other embodiments of the nozzle hole mechanism of the present invention.

FIG. 7*a, b, c, d* are other configurations of the shape of the space of the swirl chamber.

In a nozzle hole mechanism 60*a* of FIG. 7*a*, a protruding portion 61*a* of the core 11 is formed to be a spherical body, the back shape of a swirl chamber 62*b* is of the shape of a bottomed cylinder whose path side of the space is opened to be like a spherical body.

In a nozzle hole mechanism 60*b* of FIG. 7*b*, a protruding portion 61*b* of the core 11 is formed to be a conical body, the back shape of a swirl chamber 62*b* is of the shape like a bottomed cylinder whose path side of the space is opened to be like a conical body.

In a nozzle hole mechanism 60*c* of FIG. 7*c*, a protruding portion 61*b* of the core 11 is formed to be a conical body, and a recessed portion 63 of the front wall portion 22 of the nozzle piece 12 is of the shape like a conical body. Hence, the back shape of a swirl chamber 62*c* is formed to be like a conical tube whose path side of the space is opened like, a conical body. Moreover, the front shape of the swirl chamber 62*c* is like conical.

In a nozzle hole mechanism 60*d* of FIG. 7*d*, whole of the front face. 16*a* of the core 11 is formed to be curvature-shaped protruding forward. Stated differently, a part 64 of the front face 16*a* serves as a protruding portion protruding to interior of the recessed portion 26.

In the nozzle hole 60*a, b, d* of FIG. 7*a, b, d*, since the protruding portions 61*a*, 61*b*, 64 have a shape that becomes thin as it extends to the front end, in other words, the protruding portions 61*a, b*, 64 which serve as the center axis of the stock concentrate become thin, the radius of rotation of the concentrate can be made thin facing the nozzle hole 28, and the rotation speed of the concentrate in the vicinity of the nozzle hole, can be made further fast. On the one hand, in the nozzle hole 60*c* of FIG. 7*c*, since the shape of the recessed portion 63 of the nozzle piece 12 is also made thin as it extends forward, the collision of the mutual concentrate is suppressed, and the rotation speed can be made fast.

Thus, in the nozzle hole mechanism of the present invention, the shape of the protruding portion is not particularly limited as far as it can rotate the concentrate in the circular ring like hack portion of the swirl chamber, and can transmit the amplitude of the swirl and the rotational force depending on the speed to the front portion. The shape of the back portion of the swirl chamber of the present invention becomes like a circular ring by making the protruding portion to be a body of rotation centered at the axis of the nozzle hole as shown in FIG. 2 and FIG. 7*a-d*.

EXAMPLE

A spray button equipped with the nozzle hole mechanism of FIG. 2 (Example 1-3), a spray button equipped with the nozzle hole mechanism of FIG. 7*d* (Example 4) were manufactured. Moreover, a spray button equipped with the nozzle hole mechanism formed by inserting a core not equipped with the protruding portion in the nozzle piece was manufactured as comparative example 1, 2.

Details of those are as follows;

Example 1

The protruding portion 20 of the core 11: Outer diameter 1.5 mm, height 0.2 mm The recessed portion 26 of the nozzle piece 12: Inner diameter 2.0 mm, height 0.4 mm, the nozzle hole diameter 0.15 mm The path (groove path 27): Width 0.15 mm, depth 0.2 mm, four (Area of the path 0.12 $mm^2$)

In this nozzle hole mechanism 10, the outer diameter of the protruding portion 20 is 75% of the inner diameter of the recessed portion 26, the height of the protruding portion 20 is 50% of the height of the recessed portion 26, the area ratio of the path and the nozzle hole is 6.8.

Example 2

The protruding portion 20 of the core 11: Outer diameter 1.5 mm, height 0.05 mm.

The recessed portion 26 of the nozzle piece 12: Inner diameter 2.0 mm, height 0.4 mm, nozzle hole diameter 0.15 mm.

The path (groove path 27): With 0.15 mm, depth 0.2 mm, four (area of the path 0.12 $mm^2$).

In this nozzle hole mechanism 10, the outer diameter of the protruding portion 20 is 75% of the inner diameter of the recessed portion 26, the height of the protruding portion 20 is 15% of the height of the recessed portion 26, the area ratio of the path and the nozzle hole is 6.8.

Example 3

The protruding portion 20 of the core 11: Inner diameter 0.75 mm, height 0.2 mm.

The recessed portion 26 of the nozzle, piece 12: Inner diameter 2.0 mm, height 0.4 mm, nozzle hole, diameter 0.15 mm.

The path (groove path 27): Width 0.15 mm, depth 0.2 mm, four (area of the path 0.12 $mm^2$).

In this nozzle hole mechanism 10, the outer diameter of the protruding portion 20 is 37.5% of the inner diameter of the recessed portion 26, the height of the protruding portion 20 is 50% of the height of the recessed portion 26, the area ratio of the path and the nozzle hole is 6.8.

Example 4

The protruding portion 20 of the core 11: Hill-like, height of the central portion 0.1 mm.

The recessed portion 26 of the nozzle piece 12: Inner diameter 2.0 mm, height 0.4 mm, nozzle hole diameter 0.15 mm.

The path (groove path 27): Width 0.15 mm, depth 0.2 mm, four (area of the path 0.12 $mm^2$).

In this nozzle hole mechanism 61*d*, the height of the protruding portion 20 is 25% of the height of the recessed portion 26, the area ratio of the path and the nozzle hole is 6.8.

Comparative Example 1

The protruding portion of the core: None

The recessed portion of the nozzle piece: Inner diameter 2.0 mm, height 0.4 mm, nozzle hole diameter 0.15 mm.

The path: Width 0.15 mm, depth 0.2 mm, four (area of the path 0.12 $mm^2$).

In this nozzle hole mechanism, the area ratio of the path and the nozzle hole is 6.8.

Comparative Example 2

The protruding portion of the core: None

The recessed portion of the nozzle piece: Inner diameter 2.0 mm, height 0.4 mm, nozzle hole diameter 0.25 mm.

The path: Width 0.15 mm, depth 0.2 mm, four (area of the path 0.12 $mm^2$).

In this nozzle hole mechanism, the area ratio of the path and the nozzle hole is 2.4.

Figure 8:
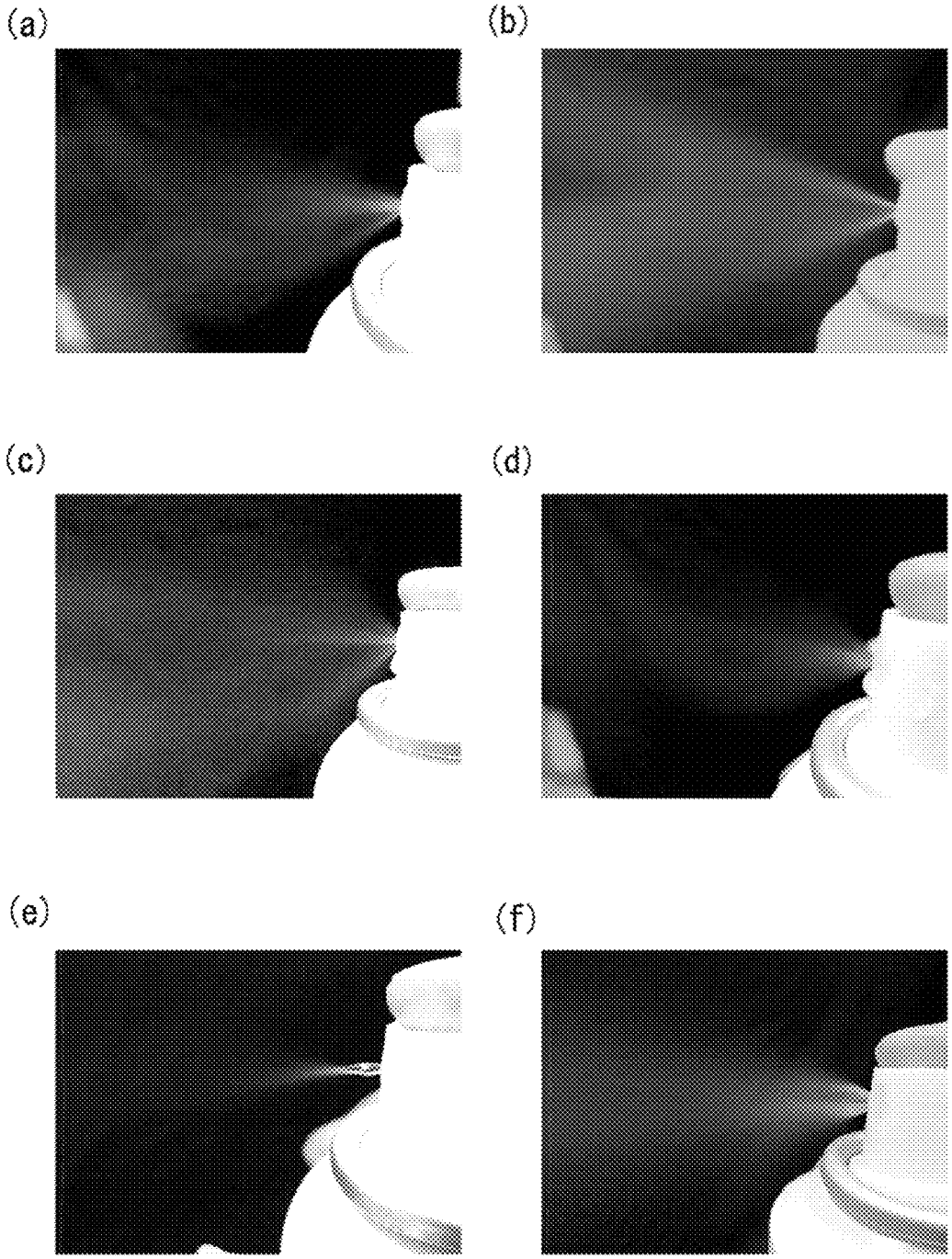
FIGS. 8*a-d* are photographic drawings of spray configuration by the embodiment 1-4.
FIG. 8*e, f* are photographic drawings of spray configuration by comparative examples.

The spray button of the above described embodiments 1-4 and the comparative examples 1-2 were attached to an aerosol container in which purified water and nitrogen gas were charged, and the spray condition was verified. The pressure in the aerosol container is 0.7 Mpa. In FIG. 8, the photographic drawings of those spray conditions are shown, and the details are shown in the next table.

TABLE 1

| | Drawing | Spray amount | Spray angle | Uniformity | Spray cross section | Water dripping off |
|---|---|---|---|---|---|---|
| Example 1 | FIG. 8a | 0.38 | 60 degrees | ○ | Circular | ○ |
| Example 2 | FIG. 8b | 0.40 | 50 degrees | Δ | Circular | Δ |
| Example 3 | FIG. 8c | 0.38 | 80 degrees | Δ | Elliptical | Δ |
| Example 4 | FIG. 8d | 0.44 | 30 degrees | ○ | Circular | Δ |
| Comparative Example 1 | FIG. 8e | 0.34 | 10 degrees | X | Circular | X |
| Comparative Example 2 | FIG. 8f | 0.58 | 40 degrees | ○ | Circular | ○ |

Spray Amount

After spraying 5 seconds, the amount was measured, and the spray amount per second (g/second) was calculated.

Spray Angle

The spray condition was photographed by a digital camera, and the angle centered at the nozzle hole was found.

Uniformity

Spraying on a paper towel 10 cm distant from the nozzle hole, the condition where water soaked into the paper towel was evaluated.

○: Water soaked in a wide range (the diameter is 5 cm or more), and uniformly.

Δ: Water soaked in a wide range (the diameter is 5 cm or more), but nonuniformly.

×: Water soaked in a narrow range (the diameter is 2 cm or less).

Spray Cross Section

The shape of cross section of the spray pattern cut perpendicular to the axis of the spray direction.

Water Dripping Off

The amount of water dripping off from the nozzle hole was evaluated. ○: None Δ: A little ×: Much In all of the examples, it was possible to make the spray angle larger than that of the comparative example 1. Particularly, in the example 1, the spray angle was as large as 60 degrees, the spray angle was stable, the sprayed concentrate attached uniformly, and the spray cross section was circular. In the example 3, although the spray angle became as large as 80 degrees, the spray was rather unstable (being not smooth, the spray condition being turbulent), and the spray cross section became elliptical. In other words, the spray angle is found to be large when the height of the protruding portion is higher than that of the recessed portion. On the one hand, in the example 2, although the spray angle was 50 degrees, the spray became rather unstable. It is speculated that in the example 2, since the protruding portion was smaller than the recessed portion, the concentrate swirled turbulently (turbulent flow) in the swirl chamber. Moreover, In the embodiment 1, there was no water dripping off.

It is speculated that since the occupying rate of the protruding portion to the recessed portion was large (the area of the swirl chamber is small), the remnant of the concentrate in the swirl chamber after spraying was small.

In the comparative example 1, the spray amount was small making the spray angle narrow. The cause is considered that the flow speed of the concentrate was low(-wed in the nozzle hole mechanism.

In the comparative example 2, the spray angle expanded as large as 40 degrees, the spray was uniform, and the spray cross section became circular, but the spray amount was too much, making the impetus strong. The concentrate did not attach to an object and dripped off.

The invention claimed is:

1. A nozzle hole mechanism used in a spray product which sprays a concentrate by pressurizing, comprising:

a nozzle hole discharging the concentrate into an atmosphere, a front swirl chamber supplying the concentrate to the nozzle hole, and a path supplying the concentrate to the front swirl chamber, wherein the front swirl chamber and the spray nozzle are located on the same axis, wherein the front swirl chamber is equipped with a front chamber having a columnar shape which communicates with the nozzle hole and a back chamber having a tubular shape, where each of a diameter of the front chamber and a diameter of the back chamber is larger than a diameter of the nozzle hole, where the front chamber and the back chamber are lined up coaxially, and wherein the path is equipped with a groove path which is formed so as to contact an outer circumference of the back chamber of the front swirl chamber and which communicates with the front swirl chamber so that the concentrate supplied to the front swirl chamber swirls in one direction in the back chamber of the front swirl chamber, an annular space where a diameter is lager than the diameter of the back chamber of the front swirl chamber, a back groove path supplying the concentrate to the annular space, a back swirl chamber supplying the concentrate to the back groove path, and a communicating hole supplying the concentrate to the back swirl chamber, wherein the back groove path is provided so as to contact an outer circumference of the back swirl chamber, wherein a depth of the groove path is the same as or smaller than a depth of the back chamber, and wherein the back swirl chamber is equipped with a back chamber having a columnar shape and a front chamber having a tubular shape, where the front chamber and the back chamber are lined up coaxially, and where a front side of the front chamber is opened to be communicated with the annular space.

2. A nozzle hole mechanism according to Claim 1, wherein the nozzle hole mechanism comprises a plurality of paths supplying concentrate to the front swirl chamber, and the plurality of paths is formed to have rotational symmetry around a center axis of the front swirl chamber.

3. A nozzle hole mechanism according to Claim 1, wherein the diameter of the nozzle hole is 0.2 mm or less.

4. A nozzle hole mechanism according to Claim 3, wherein a cross-sectional area of the path is three to ten times an area of the nozzle hole.

5. A nozzle hole mechanism according to Claim 1, wherein the diameter of the nozzle hole is 0.2 mm or less, the length of the nozzle hole is 0.05 mm-0.3 mm, and the concentrate is sprayed at an angle of 30-120 degrees.

6. A nozzle hole mechanism according to Claim 1, wherein the back chamber of the front swirl chamber is a circular tube.

7. A nozzle hole mechanism according to Claim 1, wherein an inner diameter of the back chamber of the front swirl chamber decreases. toward the nozzle hole.

* * * * *